United States Patent [19]

Janssen et al.

[11] 4,395,033

[45] Jul. 26, 1983

[54] SHINGLING WITH CONTROLLED FORCE AND/OR VELOCITY

[75] Inventors: Donovan M. Janssen; Robert Magno; William S. Seaward, all of Boulder; James A. Valent, Longmont, all of Colo.

[73] Assignee: International Business Machines Corporation, Armonk, N.Y.

[21] Appl. No.: 243,290

[22] Filed: Mar. 13, 1981

[51] Int. Cl.[3] ..... B65H 3/06

[52] U.S. Cl. ..... 271/10; 271/37; 271/110; 271/113; 271/114; 271/120; 271/251

[58] Field of Search ..... 271/113, 37, 38, 119, 271/120, 10, 109, 118, 117, 110, 111, 114, 251

[56] References Cited

U.S. PATENT DOCUMENTS

| | | | |
|---|---|---|---|
| 282,014 | 7/1883 | Stuart | 271/113 |
| 798,857 | 9/1905 | Zander | 271/119 |
| 1,264,053 | 4/1918 | Garner | 271/38 |
| 3,008,709 | 11/1961 | Buslik | 271/113 X |
| 3,276,770 | 10/1966 | Griswold | 271/10 |
| 3,583,697 | 6/1971 | Tippy | 271/10 |
| 3,737,158 | 6/1973 | Beery et al. | 271/10 |
| 3,861,671 | 1/1975 | Hoyer | 271/122 |
| 3,869,116 | 3/1975 | Kroeker | 271/160 |
| 3,934,869 | 1/1976 | Strobel | 271/35 |
| 3,989,237 | 11/1976 | Goff et al. | 271/120 X |
| 4,165,870 | 8/1979 | Fallon et al. | 271/10 |

OTHER PUBLICATIONS

Klein, W. F. et al., *IBM Tech. Disc. Bull.,* vol. 21, No. 12, May 1979, pp. 4751–4752.

Rose, L. et al., *IBM Tech. Disc. Bull.,* vol. 22, No. 1, Jun. 1979, p. 21.

Rachui, R. A., *IBM Tech. Disc. Bull.,* vol. 22, No. 6, Nov. 1979, pp. 2169–2170.

Janssen, D. M. et al., *IBM Tech. Disc. Bull.,* vol. 22, No. 11, Apr. 1980, pp. 4847–4848.

Colglazier, D. F. et al., *IBM Tech. Disc. Bull.,* vol. 20, No. 6, Nov. 1977, pp. 2117–2118.

Ludwig, J. H. et al., *IBM Tech. Disc. Bull.,* vol. 21, No. 6, Nov. 1978, pp. 2224–2225.

Hunt, R. E., *IBM Tech. Disc. Bull.,* vol. 21, No. 12, May 1979, pp. 4747, 4748–4749.

Habich, A. B., *IBM Tech. Disc. Bull.,* vol. 23, No. 12, May 1981, pp. 5612–5613.

*Primary Examiner*—Bruce H. Stoner, Jr.

*Attorney, Agent, or Firm*—Francis A. Sirr; Joscelyn G. Cockburn

[57] ABSTRACT

Device for separating and feeding sheets in seriatim from a stack to a processing station. The device includes a pin which periodically contacts and forms a pivot point on the stack. A rotary wave generator is disposed to rotate about the pivot point. The rotary wave generator periodically contacts a topmost sheet in the stack and shingles (that is separates) the sheet from the stack. The shingled sheet is fed into a paper sheet aligner and into the processing station. A variable or ramped force and/or a variable velocity is applied to the shingler. The force and/or velocity begins at a relatively low value and increases until a sheet is sensed downstream from the stack. This enables the feeding of a wide range of paper types and weights.

18 Claims, 15 Drawing Figures

SHINGLING WITH CONTROLLED FORCE AND/OR VELOCITY

CROSS-REFERENCE TO RELATED PATENT APPLICATION

Patent application Ser. No. 230,931 filed Feb. 2, 1981 entitled "Wave Generation Amplification Apparatus for Cut Sheet Paper Feeding" and assigned to the assignee of the present invention, describes a rotary shingler for shingling sheets from a stack of sheets. The shingler includes a continuously rotating arm with a plurality of free-rolling rollers coupled to the arm. The arm rotates about a pivot pin and periodically contacts the topmost sheet in a stack of sheets to separate sheets successively from the stack.

In the present invention, a ramped force and/or variable velocity is applied to the continuously rotating shingler arm. The force and/or velocity is increased or stepped through a variable range of values beginning at the lowest value in the range and increases until a sheet is sensed downstream from the stack. This enables the automatic feeding of a wide range of paper types and/or weights.

BACKGROUND OF THE INVENTION

1. Field of the Invention

The present invention relates to sheet separating and feeding device, and more particularly, to apparatus for successively separating the top sheets from a stack of sheets and for feeding the successively separated sheets from the stack. 2. Prior Art The prior art abounds with numerous devices for separating sheets from a stack and feeding the separated sheets. By way of example, U.S. Pat. No. 3,008,709 to Buslik describes a wave generator (sometimes called a combing wheel) for separating sheets from a stack. In the Buslik device, a wave generator is disposed to rotate in a plane parallel to a stack of sheets. The wave generator includes a disc fixedly attached to a rotating shaft. A plurality of free rolling balls are affixed to the disc. The rotating shaft is raised and lowered under the control of a spring and solenoid. The direction of shaft motion is generally perpendicular to the stack. In operation, the rotating disc and free rolling balls are lowered to contact the topmost sheet in the stack. The rotary motion is imparted to the stack and sheets are shingled or separated in a fan-like manner until the topmost sheet is positioned for further feeding.

U.S. Pat. No. 4,165,870 to Fallon et al. describes another prior art rotary shingler device. In the Fallon device, a metal disc is rigidly mounted to a shaft. A plurality of free-rolling wheels or rollers are mounted to the periphery of the disc. The shaft is tiltable about an axis substantially perpendicular to a stack of sheets. A drive means is coupled to the shaft and rotates the disc in a plane substantially parallel to the stack. A sheet feeding assembly including a backup surface and a rotating roller is disposed to form a feed nip relative to the stack. In operation, the shaft is tilted so that one set of the rollers contacts the topmost sheet in the stack. The shaft is then rotated and the sheet is shingled in a linear path away from the feed nip. The shaft is tilted in another direction and another set of rollers contacts the sheet shingling the sheet in the opposite direction into the feed nip.

U.S. Pat. No. 3,583,697 to Tippy is yet another example of the prior art sheet separating and sheet feeding devices. In the Tippy device, a paper stack is disposed in a tray so that the leading edge of the stack forms an angle with an axis of a pair of sheet feed rollers disposed relative to said stack. A single roller is mounted to a rotating shaft. The shaft is mounted above the stack with the periphery of the roller being in driving engagement with the topmost sheet in the stack. The geometric configuration between the elements of the sheet separating and sheet feeding devices are such that the shaft runs in a general direction parallel to the axis of the feed rollers while the single roller is positioned off-center of the stack. As the single roller rotates and is brought into contact with the topmost sheet, the sheet is rotated off the stack with its leading edge in parallel alignment with the feed rollers.

IBM$^R$ Technical Disclosure Bulletin (TDB) Vol. 21, No. 12, May 1979 (pages 4751–4752) describes a lightweight modular sheet feed and delivery apparatus for attachment to a printer. In the article, two roll wave separators of the type described in the above Fallon et al. patent are disposed for shingling sheets from two removable cassette-type hoppers. Each hopper contains different sizes and/or types of paper. As sheets are shingled from each of the respective hoppers, a pair of feed rollers feeds the shingled sheets towards a common channel. Sensors are disposed relative to each hopper. The sensor senses the leading edge of a shingled sheet and initiates a signal to deactivate the appropriate roll wave separator.

IBM$^R$ TDB Vol. 21, No. 12, May 1979 (page 4747) describes a roll wave separator of the type described in the Fallon et al. patent. In the article, the roll wave separator is slidingly connected to a shaft. The shaft is disposed relative to a stack of sheets with the roll wave separator floatingly engaged to the topmost sheet in the stack. As sheets are fed from the stack, the roll wave separator adjusts to the stack height, thus eliminating the need for a sheet elevator.

In IBM$^R$ TDB Vol. 21, No. 12, May 1979 (pages 4748–4749) describes a rotating roll wave separator of the type described in the Fallon et al. patent. The roll wave separator is disposed at the center of a stack of sheets. By contacting the stack with the roll wave separator and simultaneously applying a slight force and rotating said wave separator, a sheet is rotated from the stack.

In IBM$^R$ TDB Vol. 22, No. 6, November 1979 (pages 2169–2170) shows a picker roller paper feed device with paper depressor element. The device includes a plurality of free-rolling small wheels disposed about the periphery of a disc. When the disc is lowered into contact with a stack, the lower surface of the disc serves as a paper depressor while the free-rolling wheels dislodge a sheet from the stack along a linear path.

IBM$^R$ TDB Vol. 20, No. 6, November 1977 (pages 2117–2118) describes a combing wheel wave generator coacting with a variable force brake to feed a single sheet from a stack. The combing wheel wave generator is disposed at the front of the stack while the variable force brake is positioned at the rear of said stack. A solenoid controls the brake so that its force on the stack is decreased when the combing wheel is in contact with the stack.

U.S. Pat. No. 3,989,237 to Goff describes a variable force sheet feeding device wherein a variable force means applies a horizontal force to the topmost sheet on a stack. The force is increased until the sheet buckles.

As the buckle is sensed, the feed means changes the direction in which the force is applied and the sheet is fed along a linear path from the stack. The process of buckling the sheet in one direction and feeding said sheet in the opposite direction, is a reliable method to feed paper of varying types and/or weights.

U.S. Pat. No. 3,861,671 describes a document handling device wherein a bail bar is utilized to provide a normal force on a stack of sheets to enable a feed roll therebeneath to positively feed a single document or a number of documents from the stack beneath the bail bar. Bail bar pressure on the feed roll is released after initial feeding of each document to allow multifeed documents to be returned to the document stack by a suitable document return mechanism.

U.S. Pat. No. 3,869,116 describes a card feed device having a magnetic force application mechanism to apply a normal force to a stack of cards. A feed roll disposed beneath the stack feeds card forms from the stack.

U.S. Pat. No. 798,857 describes a variable weight mechanism which is applied to the top of a stack to enable feeding of sheets from the bottom.

Although the above prior art wave generator sheet separating devices work satisfactory for their intended purpose, there appears to be a lack of control between the devices and sheets in the stack. The lack of control results in double sheet feed from the stack, inconsistent positioning of the sheet relative to a subsequent sheet feed apparatus and relatively long shingle time. It is believed that the lack of control is caused by the fact that the stack is not perfectly flat, therefore, the plane of the paper is not parallel to the plane of the wave generator sheet separating devices. The nonparallelism between the stack and sheet separating device is usually brought about by environmental conditions. For example, humid conditions tend to cause the paper to raise and buckle. Attempts to control the environment tend to be costly and nonacceptable.

Another drawback associated with the above prior art devices is the inability to handle a wide range of paper types and weights. The Goff patent solves the problem by buckling the sheet and then feeding in a direction opposite to the buckle. Although this approach works well for low speed devices, it is unacceptable for high speed devices. Usually the time used to buckle and then feed a sheet is greater than the time allotted to feed a sheet in a high performance device. This is particularly true in machines such as convenience copiers wherein a sheet must be delivered to transfer station within a relatively short time so that a developed image can be transferred to the sheet.

SUMMARY OF THE INVENTION

It is therefore a general object of the present invention to provide a more efficient and reliable sheet separator than has heretofore been possible.

It is another object of the present invention to separate and to feed sheets from a stack in a more controlled manner than has heretofore been possible.

It is yet another object of the present invention to feed paper having variable characteristics and weights automatically.

The above and other objects of the present invention are achieved through a sheet handling apparatus having a continuously rotating arm with a plurality of free-rolling rollers mounted to said arm. The arm rotates about a spring loaded pivot pin to shingle sheets successively from a stack. The continuously rotating arm is coupled to a first motor which drives the arm with a variable velocity. A second motor is coupled to said arm and imparts a variable normal force thereto. By varying the normal force and/or the velocity of the rotating arm, sheets having a wide range of weight and feed characteristics are sequentially separated from a stack. The separation does not require the intervention of an operator.

In one embodiment of the invention, a sensor means is disposed to sense the leading edge of a shingled sheet and to generate a signal. The signal disables a motor which rotates the arm and enables the second motor to retract (that is lift) the arm from contact with the stack of sheets.

In another embodiment of the invention, a sheet feed mechanism accepts and reorientates the sheet for proper entry into a paper aligner. After alignment, the sheet is fed by a pair of servo-controlled rollers into a processing station such as the transfer station of a convenience copier.

In a preferred configuration, the elements of the above sheet separating and sheet feeding device are disposed so that the spring loaded pivot pin is suspended above the stack and off-center thereto. The rotating arm carrying the free-rolling members is also suspended above the stack. The arm is rotated to define a circular trajectory with the pin disposed at the center of said trajectory. The arm and pivot pin assembly is raised and lowered in accordance with the angular position of a sheet relative to the point at which the pivot pin contacts the stack. The sheet feed mechanism includes two pairs of spaced feed rollers mounted onto two rotating shafts. Each pair of rollers coact to form a sheet feed nip. The shafts are disposed in a direction generally parallel to the leading edge of the stack.

The foregoing and other features and advantages of the invention will be apparent from the following more particular description of a preferred embodiment of the invention, as illustrated in the accompanying drawings.

DETAILED DESCRIPTION OF THE PREFERRED EMBODIMENT

As is used in this application, the words "wave generator" and "combing wheel" are used interchangeably. The words refer to the general type of sheet separating devices wherein waves rather than friction are used to separate the topmost sheet from a stack of sheets.

The sheet feeding device to be described hereinafter, finds use with any type of utilization device such as printing presses, convenience copiers, printers, etc. The invention is particularly suited for feeding sheets at high speed to the transfer station of a high performance copier. As such, the invention will be described in this environment. However, this should not be construed as a limitation on the scope of the invention since it is the intent that the invention be applicable to any environment in which it is required for feeding sheets from a stack.

Figure 2A:
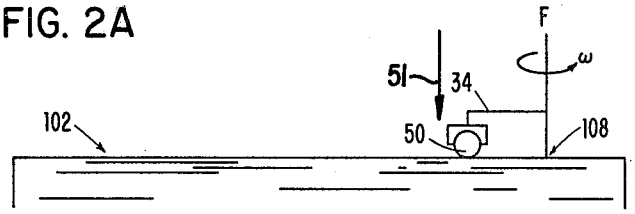
FIGS. 2A and 2B are schematics showing the geometric relation between a shingled sheet and the pivot point whereat a stack of sheets is restrained during shingling. The showing is helpful in understanding the consistency with which a sheet is separated from the stack and the positioning of a sheet feeding device to feed the sheet downstream from the stack.
Figure 2B:
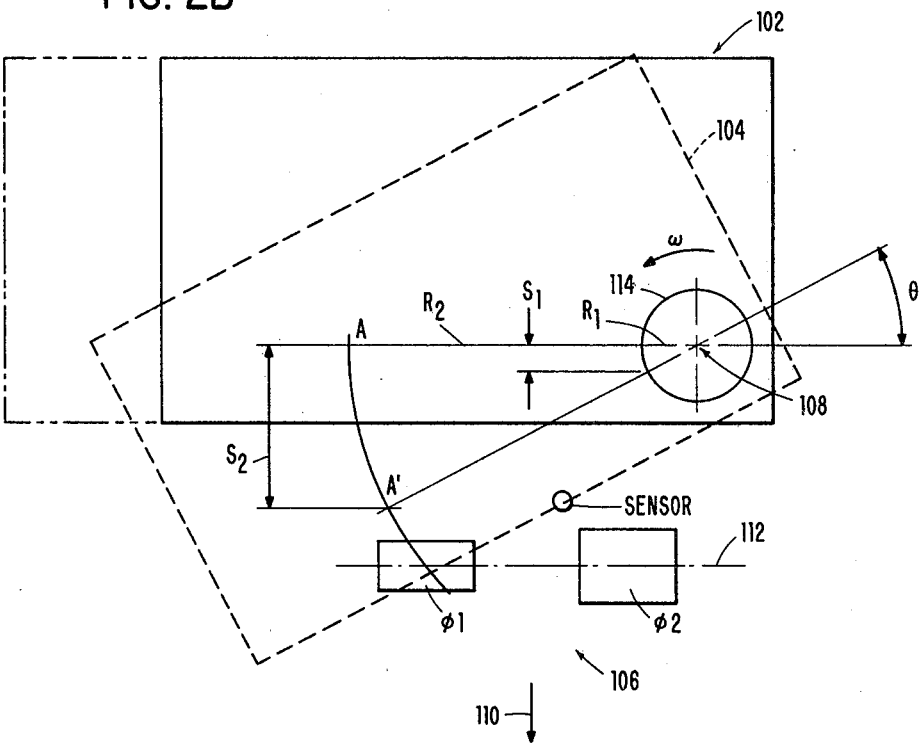
Figure 8A:
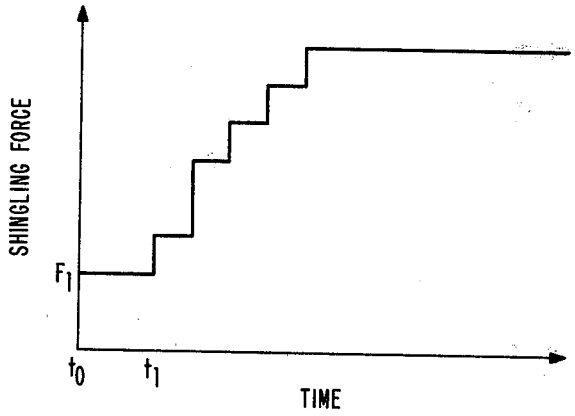
FIGS. 8A and 8B show a conceptual view of the present invention wherein a variable force ramp and/or a variable velocity ramp is applied to a rotary shingler to separate sheets having a wide range of feed characteristics and weights from a stack.
Figure 8B:
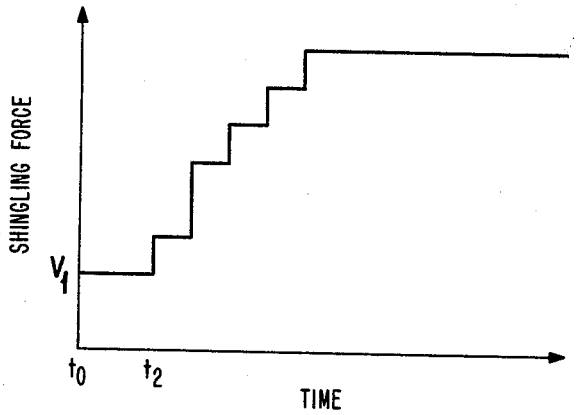

FIGS. 2A, 2B, 8A and 8B are helpful in understanding the present invention. A more detailed description of the figures and, in particular, FIGS. 2A and 2B are given subsequently. A stack of sheets identified by numeral 102 (FIG. 2B) is placed within a sheet support tray. Preferably, the sheet support tray is fitted with a reference edge or surface against which the sheets are referenced. The topmost sheet in the stack is subjected to a rotating member 34 (FIG. 2A) carrying free-rolling rollers, only one of which is shown in the figures and identified as roller 50. The rotary motion separates sheet 104 (FIG. 2B) from the stack. A variable normal force represented by arrow 51 and/or a variable velocity represented by $\omega$ is supplied to the free-rolling rollers. Although any other force or velocity profile can be used as is shown in FIGS. 8A and 8B, the preferable force and velocity profiles are ramp functions. Prior to time $t_0$ no force and/or velocity is exerted on the top sheet. This corresponds to the standby condition wherein there is no need to feed a sheet. When such a need arises, the variable force and/or variable velocity mechanism contacts the topmost sheets. At time $t_0$ a force $F_1$ and/or velocity $V_1$ is applied to the mechanism. The application is for a short interval of time. If the leading edge of sheet 104 is not sensed by the sensor (FIG. 2B), the force and/or the velocity is stepped to a higher value. The process of increasing the force and/or velocity continues until a sheet is sensed. The mechanism is then lifted from the stack.

In order to pick another or subsequent sheet, the mechanism is lowered onto the stack and the process (that is stepping the force and/or the velocity) is repeated.

It has been found that reliable separation and feeding of single sheets is achieved by varying the normal force and velocity of the shingler singly or simultaneously. The separation and feed is independent of the sheets' texture, weight, moisture content, feed characteristics, etc. By ramping the force and/or the velocity from a low value to a high value, the sheets (particularly light weight sheets) are separated without overshooting the sensors which sense sheet separation from the stack.

Figure 1:
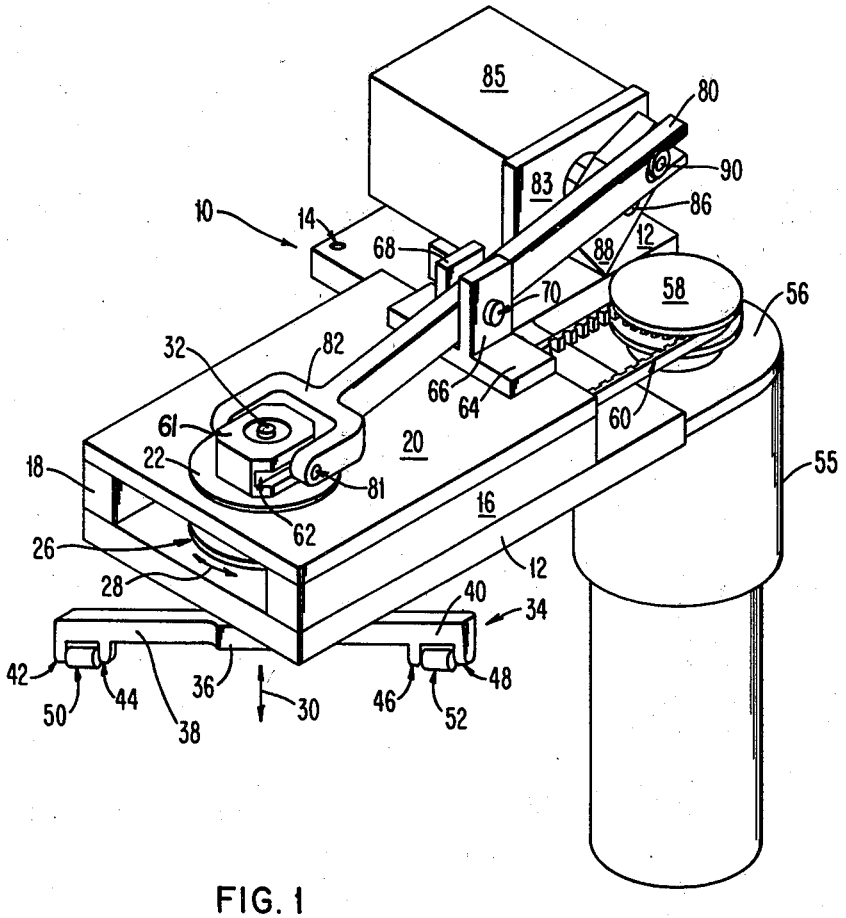
FIG. 1 shows an isometric view of the wave generator sheet separating device.

FIG. 1 shows the sheet separator means 10 according to the teaching of the present invention. The sheet separator means 10 includes a base member 12. The base member is fitted with a plurality of holes suitable to mount the base member and the attached components to a support means (not shown). In FIG. 1, one of the support holes is shown and identified with numeral 14. A pair of rectangular members 16 and 18 respectively are disposed on the surface of base member 12 and extend upwardly therefrom. A rectangular member 20 is fastened onto the top surface of the rectangular members. The orientation is such that the rectangular members 16 and 18 are disposed on the surface of base member 12 in spaced relationship with respect to one another and the rectangular member 20 is disposed in a plane parallel to base member 12 and in spaced relationship thereto. A dual function bearing assembly 17 (FIG. 5) is mounted by disc 22 onto rectangular member 20. A hollow shaft 24 (FIGS. 3, 4 and 5) extend downwardly from the disc 23 through an opening in base member 12. A pulley 26 is mounted to the shaft 24. The pulley is positioned within the opening between the low surface of rectangular member 20 and the upper surface of rectangular member 12.

Figure 3:
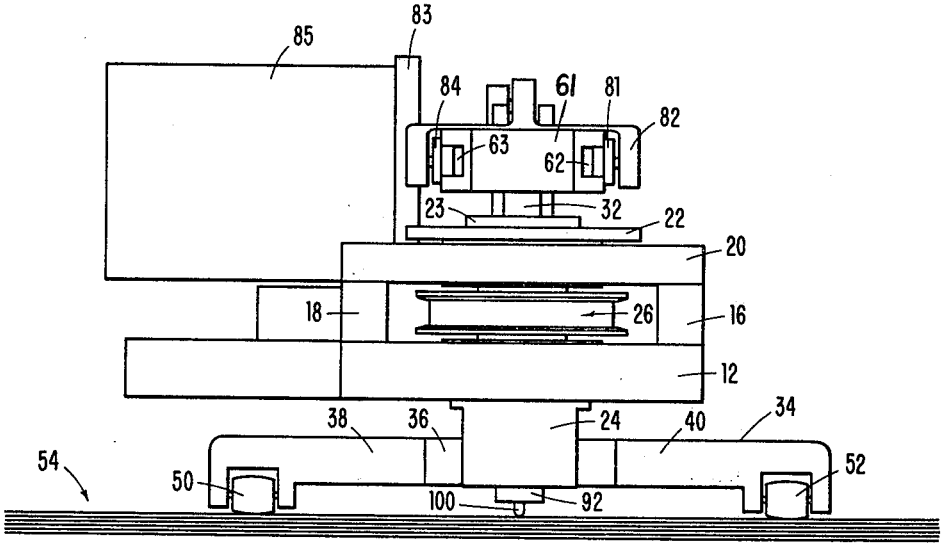
FIG. 3 is a front view of the wave generator sheet separating device with the rotary section of the device lowered so that the free rolling elements are in contact with the topmost sheet in the stack.
Figure 4:
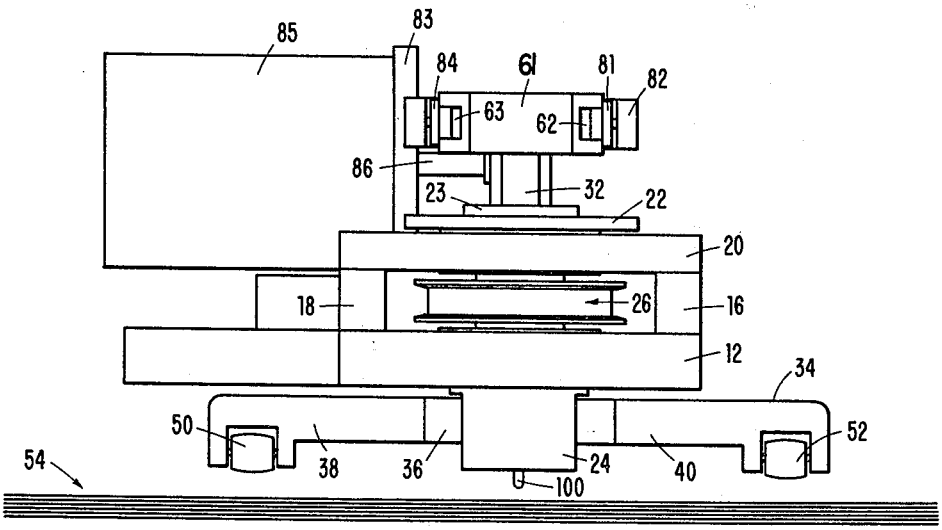
FIG. 4 shows a front view of the device with the rotary section in a raised position.

Referring now to FIGS. 1, 3 and 4 in which identical numerals are used to identify common elements, the shaft 24 extends below the bottom surface of base member 12. As will be explained subsequently, the dual function bearing assembly 17 (FIG. 5) allows rotary motion in the direction shown by arrow 28 (FIG. 1) and linear motion in the direction shown by arrow 30. A shaft 32 is slidably mounted within the dual function bearing assembly. An elongated member 34 is fixedly mounted to one end of shaft 32. The elongated member tapers from its central section 36 towards the end sections 38 and 40 respectively. Stated another way, the elongated member 34 is wider in the middle than it is at both ends. Projections 42 and 44 are configured in spaced relationship and at one extremity of elongated member 34. Likewise, projections 46 and 48 are positioned in spaced relationship and extend from the other extremity of the elongated member. Mounting pins (one each) are fixedly mounted to each pair of spaced projections and free rolling rollers 50 and 52, respectively, are mounted to the pins. The free-rolling rollers or wheels are preferably fabricated from a low friction metal or hard plastic. However, it is envisioned within the teaching of this invention, that resilient rubber or other elastomeric rollers may be used. In the preferred embodiment of the invention, the rollers are slightly elongated in shape. As will be explained subsequently and as can be seen more clearly in FIGS. 3 and 4, the shaft 32 with its attached elongated member and rollers, can be raised or lowered (that is transported linearly) to contact a stack of sheets 54. Simultaneously with contacting the sheets, the elongated member and free-rolling rollers are rotated by shaft 24 and sheets are shingled from the stack.

Still referring to FIGS. 1, 3 and 4, a drive motor 55 is mounted to a motor support plate 56. The motor support plate 56 is fastened to the lower surface of base member 12. The drive shaft of the motor (not shown)

extends upwardly above the top surface of support plate 56. A drive pulley 58 is fixedly mounted to the drive shaft. A drive belt 60 couples pulleys 26 and 58, respectively. As the motor shaft rotates, the rotary motion is transferred through pulley 58 and drive belt 60 to rotate the elongated member 34 and the attached free-rolling rollers 50 and 52 respectively. As will be explained subsequently, the motor 55 is controlled so that the elongated member 34 rotates with a variable velocity.

Still referring to FIGS. 1, 3 and 4, the upper end of shaft 32 is journaled for rotation in bearing assembly 61. The housing of bearing assembly 61 is octagonal in shape and is fitted with a pair of grooves on opposite sides thereof. In FIG. 1, only one of the grooves is shown and is identified with numeral 62. The other groove is identified with numeral 63 and is clearly shown in FIGS. 3 and 4, respectively. A bracket 64 is fixedly mounted to the upper surface of rectangular member 20. The bracket includes members 66 and 68 respectively. The members are configured in spaced-apart relationship and extend upwardly from the base of bracket 64. A pivot pin 70 is mounted in members 66 and 68 respectively. An elongated mechanical arm 80 is pivotally mounted to pin 70. One end of the arm is fitted with a U-shaped member 82 while the other end is bifurcated. Mechanical couplings 81 and 84 respectively are mounted to each side of the U-shaped member. The couplings are disposed to ride in the grooves 62 and 63 of the bearing house. The fit between the mechanical couplings and the bearing house is such that the housing has an oscillatory motion with respect to the couplings.

Still referring to FIGS. 1, 3 and 4, an L-shaped bracket member 83 is bolted to the top surface of base member 12. The configuration is such that the horizontal portion of the L is bolted to the base member and the vertical portion of the L extends upwardly therefrom. An actuator means 85 is fixedly attached to L-shaped bracket member 83. In the preferred embodiment of this invention, the actuator means 85 is a bidirectional rotary motor with shaft 86 of the motor extending through a hole in the L-shaped bracket member. A mechanical coupler 88 is pivotally coupled to the motor shaft. The mechanical coupler is mounted at its central section to the shaft. A pin 90 is fixedly mounted to the mechanical coupler. The pin is mounted at a point off-center from the point at which the mechanical coupler pivots about the shaft 86. The free end of the pin is slidably mounted within the opening in the bifurcated end of elongated arm 80. As will be described subsequently, when the bidirectional rotating motor 85 is activated, it can lower or raise the elongated member 34 so that the free-rolling rollers 52 and 50, respectively, contact the pile of sheets 54. The motor 85 is also controlled so that a variable force is applied to the stack. By controlling the current flowing in the motor, the force is adjusted until a sheet is sensed downstream from the stack. It should be noted that although a bidirectional rotary motor is used for raising and lowering the elongated member 34, other types of actuator means can be used. By way of example, a solenoid could be used to raise or lower the arm.

Turning to FIG. 3 for the moment, as the elongated arm 34 is lowered to contact a stack of sheets, a force generating assembly 92 contacts the stack to form a pivot point therewith. As will be explained subsequently, the elongated member 34 rotates about the pivot point to shingle or separate sheets from the stack.

Figure 5:
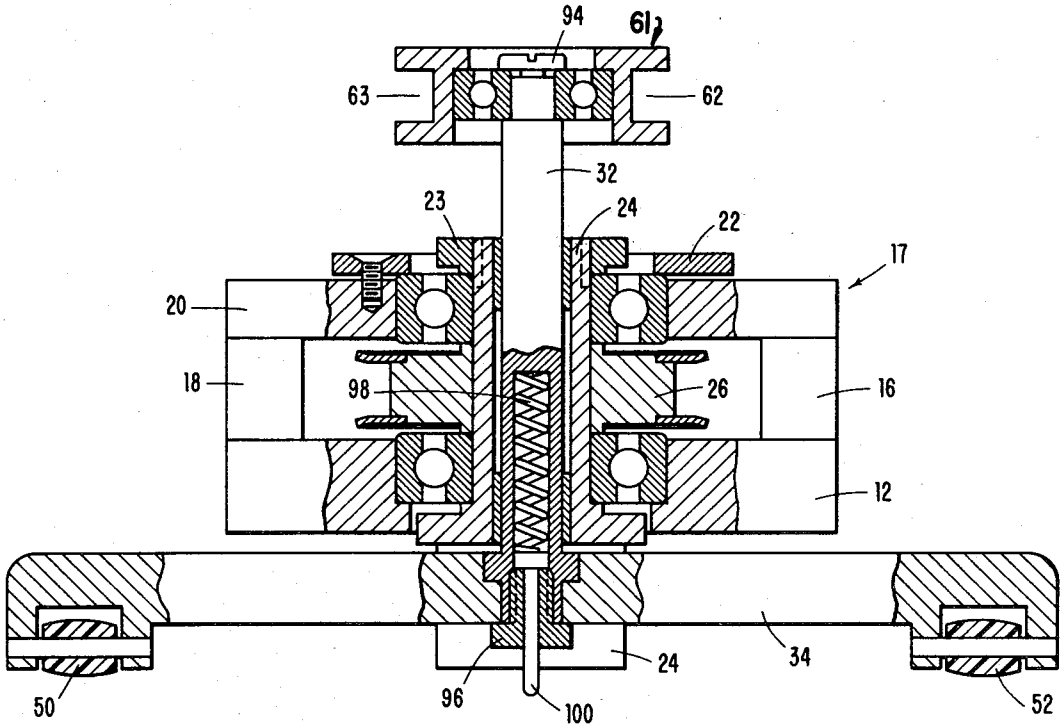
FIG. 5 is a cross-section through the wave generator and the spring loaded pivot pin.

FIG. 5 is a view showing a cross-section of elongated member 34 and the mechanical devices which allow the elongated member to rotate in a plane parallel to a stack of sheets and for linear motion in a plane substantially perpendicular to the plane of rotation. Also, elements which are identical to previously described elements are identified with the previously used numerals. As was stated previously, shaft 32 has both linear and rotary motion. The linear motion enables elongated member 34 to be lowered so that the free-rolling rollers 50 and 52, respectively, contact the topmost sheet in a stack of sheets. One end of shaft 32 is fitted with a shoulder about its periphery. The rotary bearing assembly 61, is mounted to said shoulder. The rotary section of the bearing is coupled to the shaft by fastening means 94. In the preferred embodiment of the present invention, fastening means 94 is a screw. Of course other types of fastening means can be used without departing from the scope of the present invention. Grooves or channel 63 and 62 are fabricated in the bearing housing. As was stated previously, a pair of mechanical members extending from an elongated lever are coupled through sliders into these grooves. By actuating the elongated lever about a pivot point, shaft 32 is transported upward or downward with respect to a stack of sheets. Stated another way, shaft 32 is transported perpendicular to a stack of sheets. It should be noted that rotary bearing assembly 61 only performs a rotary function, and does not allow relative linear motion between shaft 32 and assembly 61.

A linear/rotary bearing assembly 17 is coupled to shaft 32. The linear/rotary bearing assembly 17 allows linear motion of shaft 32 and enables shaft 32 to rotate. The linear/rotary assembly 17 is elongated and is supported at each extremity by a pair of ball bearings. The linear/rotary assembly 17 includes a pulley 26. The pulley is coupled to hollow shaft 24. The hollow shaft is slotted and drives elongated member 34. As was stated previously, pulley belt 60 (FIG. 1) is coupled to the pulley and when motor 55 (FIG. 1) is activated, the shaft 24 is rotated clockwise or counterclockwise. The linear/rotary bearing assembly 17 has a bearing retaining disc 22 (FIG. 1) which is used for mounting the linear/rotary bearing assembly 17 to the frame of the rotary shingler and a bearing clamp 23 which is used with shaft 24 to capture the bearing assembly and pulley 26. The fit between hollow shaft 24 and shaft 32 is such to allow linear motion between shaft 24 and shaft 32. Since linear/rotary bearing assemblies are state of the art devices, a more detailed description of its mechanical components will not be given. Suffice it to say that the linear/rotary bearing assembly is coupled to shaft 32 and enables the shaft to rotate on an axis perpendicular to a stack of sheets and to translate linearly along that axis.

Still referring to FIG. 5, the rotary elongated member 34 is fitted by screw 96 to the lower extremity of shaft 32. A hole is bored inside of shaft 32 and a coil spring 98 is fitted within the hole. A nail-shaped force application pin 100 is fitted inside the hole. A good portion of the pin member extends from the lower surface of shaft 32. The lower end of coil spring 98 rides on the top of the disc portion of the nail-shaped member. As such, the pin member is biased towards the stack of sheets upon which it rides. As such, when the shaft 32 is positioned so that the external point of nail-shaped member 100 contacts the pile, a force is transmitted through the pin onto the stack. Additionally, the pin forms a pivot point with the stack, and the elongated member 34 rotates about that pivot point. As such, the amplification ratio which each sheet experiences as it is shingled from a stack is greatly enhanced and is independent of the size of the members or sheets in the stack. The enhanced amplification ratio reduces the probability of double feed since the separation between fanned out sheets is greater than has heretofore been possible.

FIG. 2A is a sketch showing a side view of the rotary shingler disposed in a preferred position relative to a stack of sheets 102. FIG. 2B shows the geometric relationship between a sheet 104 as it is rotated from the stack and sheet feed device 106 which is disposed downstream from stack 102. FIGS. 2A and 2B are helpful in understanding the theory which makes the rotary shingler described herein more efficient than other prior art rotary shinglers. The pivot pin 100 (FIG. 5) contacts the stack and forms pivot point 108 (FIG. 2A). The rotary member 34 (FIGS. 3, 4, 5) is rotated in the direction identified by $\omega$. As was stated previously, by varying the velocity of the rotary member, a sheet is picked more efficiently from the stack. A force (F) is supplied at the pivot point by spring 98 (FIG. 5). In FIG. 2A, only ½ of the elongated member with one free-rolling roller 50 is shown. In actuality, two rollers contact a stack. As was stated previously, by varying the force with which the rollers contact the stack, sheets are separated more efficiently from the stack.

Figure 7:
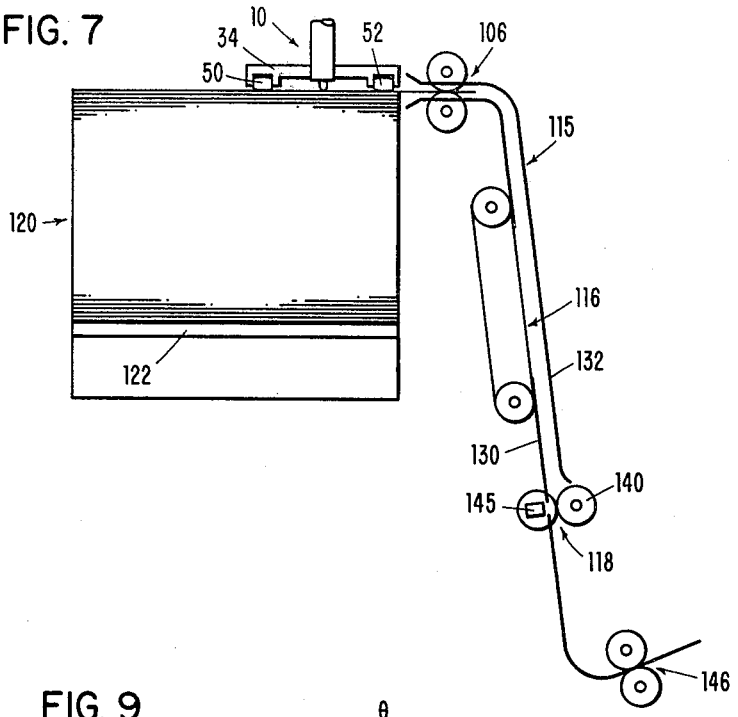
FIG. 7 is a side view of the sheet processing apparatus of FIG. 6.
Figure 9:
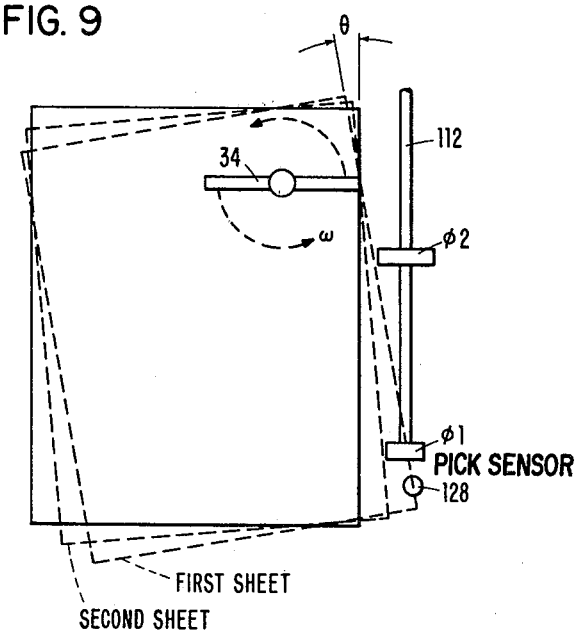
FIG. 9 shows a stack of sheets and a pick sensor disposed relative to fanned-out sheets.

In FIGS. 2A and 2B, the preferred orientation is that the rotary shingler mechanism 10 is placed in a corner of the stack of sheets. Stated another way, the preferred embodiment is that the rotary shingler be placed off-center of the stack of sheets. The pick and feed mechanism 106 is located near the other end. In the preferred embodiment of this invention, the feed mechanism 106 includes feed rollers Ø1 and Ø2 and a pair of backup rollers (not shown). The feed rollers and the backup rollers (not shown) coact to form feed nips. Ø1 is opened and closed upon command. Ø2 is always closed. As will be explained subsequently, as a sheet such as 104 is rotated from the stack by the rotary shingler, the sheet falls in the nip and is fed forward in the direction shown by arrow 110. Feed rollers Ø1 and Ø2 are rigidly mounted to shaft 112. The feed rollers are in spaced relationship on the shaft and the backup rollers (not shown) are disposed relative to the feed rolls to form the feed nip. As was stated previously, the rotating member is mounted to one corner of the stack. The member is rotated in the direction $\omega$. The trajectory which is traced out by the rotating member is identified by circle 114. The center of the circle forms pivot point 108. As is evident from the geometry, sheet 104 and others similarly situated are fanned out from stack 102 in a counterclockwise direction. The rotary member continues to shingle the sheet until the leading edge of the sheet comes under the influence of the sensor. At this point, the sensor outputs a signal and the signal is used to stop the rotary shingler from rotating and also lifts it from the topmost sheet. The sheet is now between the open nip of Ø1. Upon machine command, the Ø1 nip is closed and the sheet is accelerated into the path 115 (FIG. 7). The angle of separation $\theta$ is maintained until the sheet comes under the influence of Ø2. The sheet is then fed and realigned into a regular paper path of a machine. Instead of positioning the sensor at the point shown in FIG. 2B, it can be disposed on axis 112 (FIG. 9). A preferred location is that the sensor be disposed to the left of feed roll Ø1, as shown at 128 (FIG. 9). It should also be noted that the diameter of feed roll Ø2 is larger than that of feed roll Ø1. This difference is geometry attempts to rotate the sheet in a clockwise direction and hence align the edge of the sheet to be parallel with the axis upon which the feed rolls are rotating. The preferred configuration is that axis 112 be parallel to the leading edge of the stack (FIG. 9). In FIG. 2B, the stack 102 carries different size sheets. For example, the sheets form in stack 102 which is identified by solid line defines paper having a first size while the extension of the solid line formed with broken lines represent another size sheet. It should be noted that the effectiveness of the present shingler is independent of sheet size. Stated another way, a sheet such as 104 regardless of its size, will be shingled off at a constant angle $\theta$. By using the pivot point on the stack, the amplification ratio of sheets separated from the stack is enhanced. Assume in FIG. 2B that R1 equals the radius of the rotary shingler. R2 equals the radius of interest. With pivot point 108 as center, an arc is drawn and on the drawn arc a point A travels from its location on R2 to a second point A'. By observing the geometry of the figure, the following expression can be written:

$$R_2/R_1 = \text{Shingle Amplification Ratio.}$$

Assuming that $R_1$ equals unity, then as $R_2$ increases from $R_1$, the shingle amplification ratio increases. This is an important feature in the present invention, because it enables the pick and feed mechanism 106 to separate sheets more efficiently with a reduced probability of double feed. Stated another way, since the separation between sheets fanned out from the stack is greater, the probability of the pick and feed mechanism to feed a double sheet is significantly reduced.

If the topmost sheet on stack 102 is shingled until it rotates over the top of the sensor, then the distance $S_1$ (FIG. 2B) that the top sheet moves due to wave generation at the roller is $R1 \times \theta$ and the time to shingle $S_1$ is a function of $\omega$, F, (FIG. 2A) and the paper characteristics. However, in the same time, point A moved a distance $S_2$, which is equivalent to:

$$S_2 = S_1 R_2 / R_1$$

This shows that the angle $\theta$ will be constant for all form lengths, and can be corrected by feeding through two nips of constant angular velocity but different diameters or any other adjustment means. Alternately, if one does not with to use an intermediate means for adjusting the separated sheet with a paper path of a utilizing apparatus, then the paper tray and the feed assembly can be disposed at an angle $\theta$ with respect to the utilization paper path.

Figure 6:
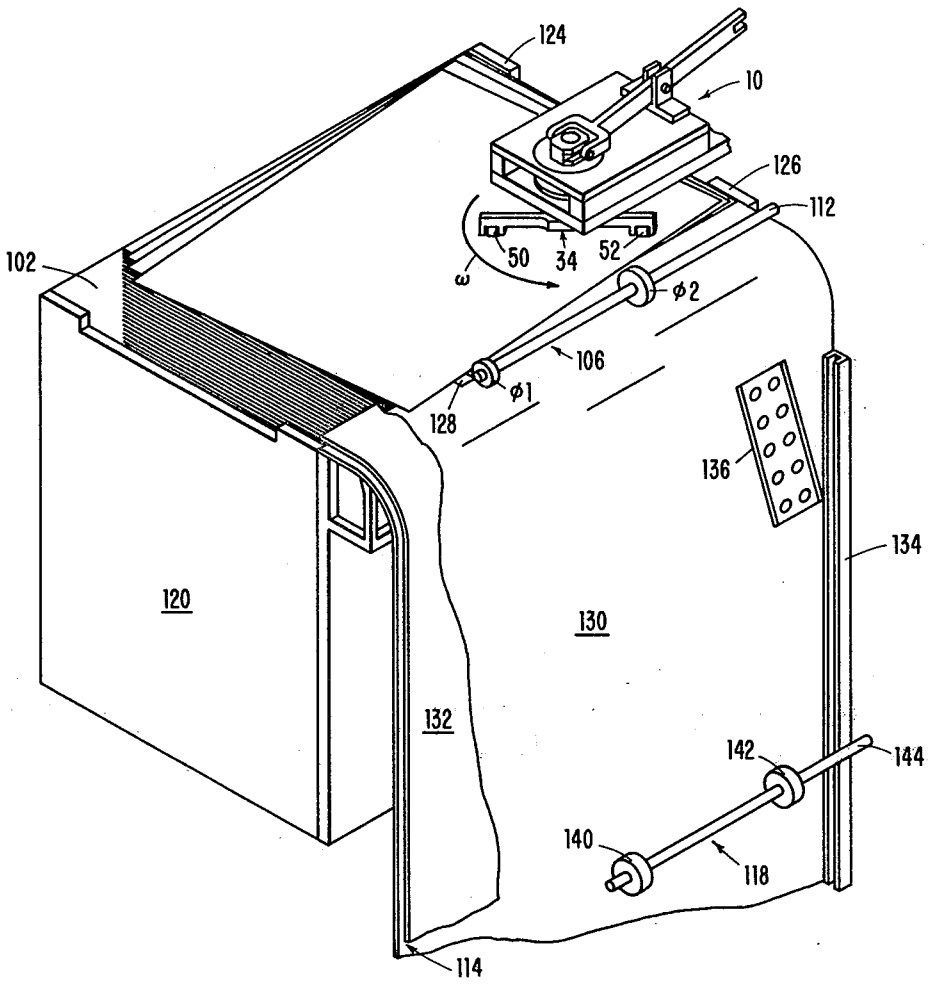
FIG. 6 shows the sheet separating device in combination with a sheet feed mechanism, an aligner and servo-controlled rollers for feeding the sheet into a processing station of a printer.
Figure 11:
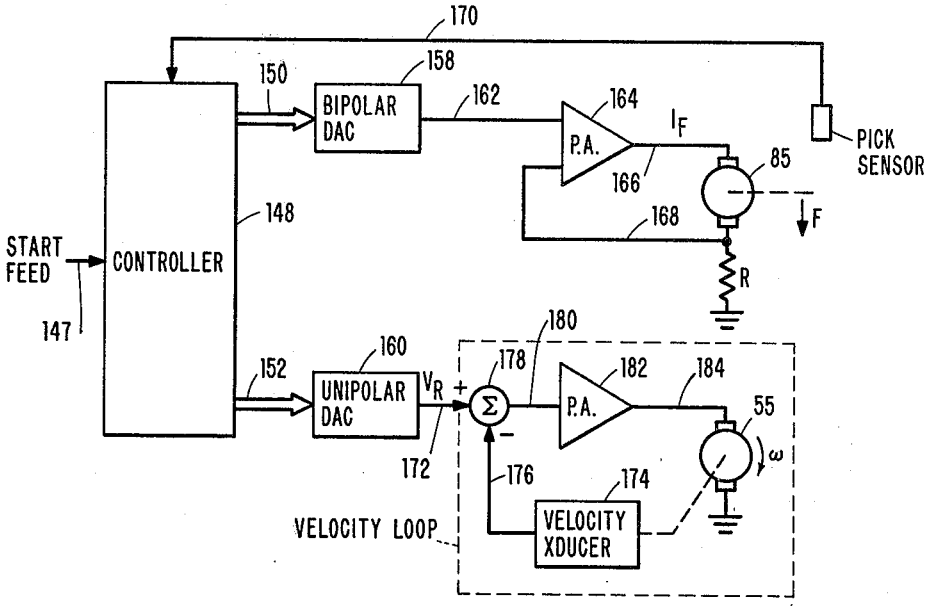
FIG. 11 is a schematic of an electronic system used to generate the variable force and/or variable velocity.

FIGS. 6, 7 and 11 show a modular paper handling apparatus according to the teaching of the present invention. The devices of the modular paper handling apparatus coact to feed sheets in seriatim from the top of a stack into the paper path 115 of a utilization device. From the paper path it is fed into a processing station. In the preferred embodiment of this invention, the paper path is that of a convenience copier and the processing station is the transfer station of said copier. Of course this invention can be applied to other types of utilization devices without departing from the scope of the present invention. Elements in these drawings which are common to previously described elements will be identified by the previously used numerals. The paper handling device comprises of the rotary shingler 10, a sheet pick and feed mechanism 106, a sheet aligner 116 and a servo-controlled gate assembly 118. A paper support bin 120 with a movable support bottom 122 is disposed relative to a paper path 115. A pair of alignment surfaces 124 and 126 are disposed on one side of the paper support bin. In operation, a stack of sheets 102 is loaded in the paper support bin 120. The edge of the stack is aligned against reference surfaces 124 and 126, respectively. The rotary paper shingler 10 is disposed above the stack and in one corner thereof. The rotating member 34 with free-rolling rollers 50 and 52 respectively, rotates in the direction shown by arrow $\omega$. As will be explained subsequently, when the pivot pin contacts the top of the stack and the free-rolling elements make the circular motion on the stack, sheets to be fed forward are fanned out from the stack. A pair of feed rollers Ø1 and Ø2 are mounted in spaced relationship on rotating shaft 112. The configuration is disposed so that the shaft is parallel to the edge of the aligned stack in the support bin. Pick sensor 128 is disposed relative to the shaft and senses when a sheet is fanned from the top of the stack. The signal outputted from the sensor is used to inhibit the rotary member from rotating and ultimately lifting the same from the stack.

Turning to FIG. 9 for the moment, a sketch of the pick sensor and the feed nip relative to the stack is shown. The sketch also shows the relationship of the sheets as they are shingled from the stack. Also, the constant angle $\theta$ at which the sheet leaves the stack is shown. In the preferred embodiment of this invention, $\theta$ is approximately 10°.

Figure 10:
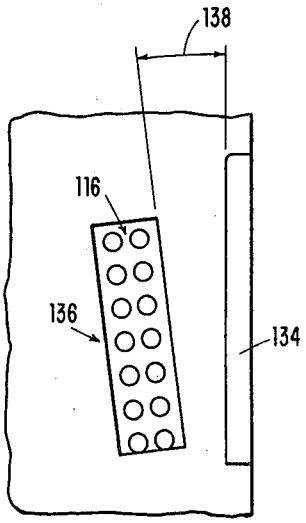
FIG. 10 shows an exploded view of the paper aligner including a vacuum transport belt and an edge alignment member.

Referring now to FIGS. 6 and 7, the utilization channel 115 includes a bottom support plate 130 and a top support plate 132. The support plates are configured with a space therebetween so that sheets which are peeled off from the stack feed readily into the channel. The bottom support plate 130 is fitted with a paper aligner and a reference guide member 134. In the preferred embodiment of this invention, the paper transport means 136 is a vacuum transport belt whose surface slightly protudes above the surface of bottom support plate 130. The function of the reference guide member 134 is to align sheets travelling through the path. Turning to FIG. 10 for the moment, the vacuum transport belt is disposed at an angle to the edge guide element 134. In the preferred embodiment of this invention, the angle 138 which the vacuum transport belt forms with the aligning member is approximately 7°. Of course, any other type of edge alignment mechanism or a different angle of inclination may be used without departing from the scope of the present invention.

From the aligner, the paper is fed into a servo-controlled sheet handling gate assembly 118. The servo-controlled gate assembly includes a pair of feed rollers 140 and 142 (FIG. 6) respectively, mounted to a rotating shaft 144. A pair of back-up rolls mates with the feed rollers 140 and 142 respectively to form the feed nip through which the paper is fed at a controlled rate. The feed rolls cooperate with sensor 145 to form a gate (see FIG. 7). In operation, sheet position is determined by sensor 45 from which a control signal is generated which speeds up or slows down the rate of paper so that it accurately matches the proper position of a toned image on a photoconductor drum (not shown). A more detailed description of such an arrangement is given in IBM TECHNICAL DISCLOSURE BULLETIN Vol. 22, No. 12, May 1980, entitled "Servo-Controlled Paper Gate" by J. L. Cochran and J. A. Valent. Another pair of feed rollers 146 is disposed downstream from the servo-controlled gate assembly 118 and merely feeds the accelerated or decelerated sheets onto the photoconductor.

Figure 12:
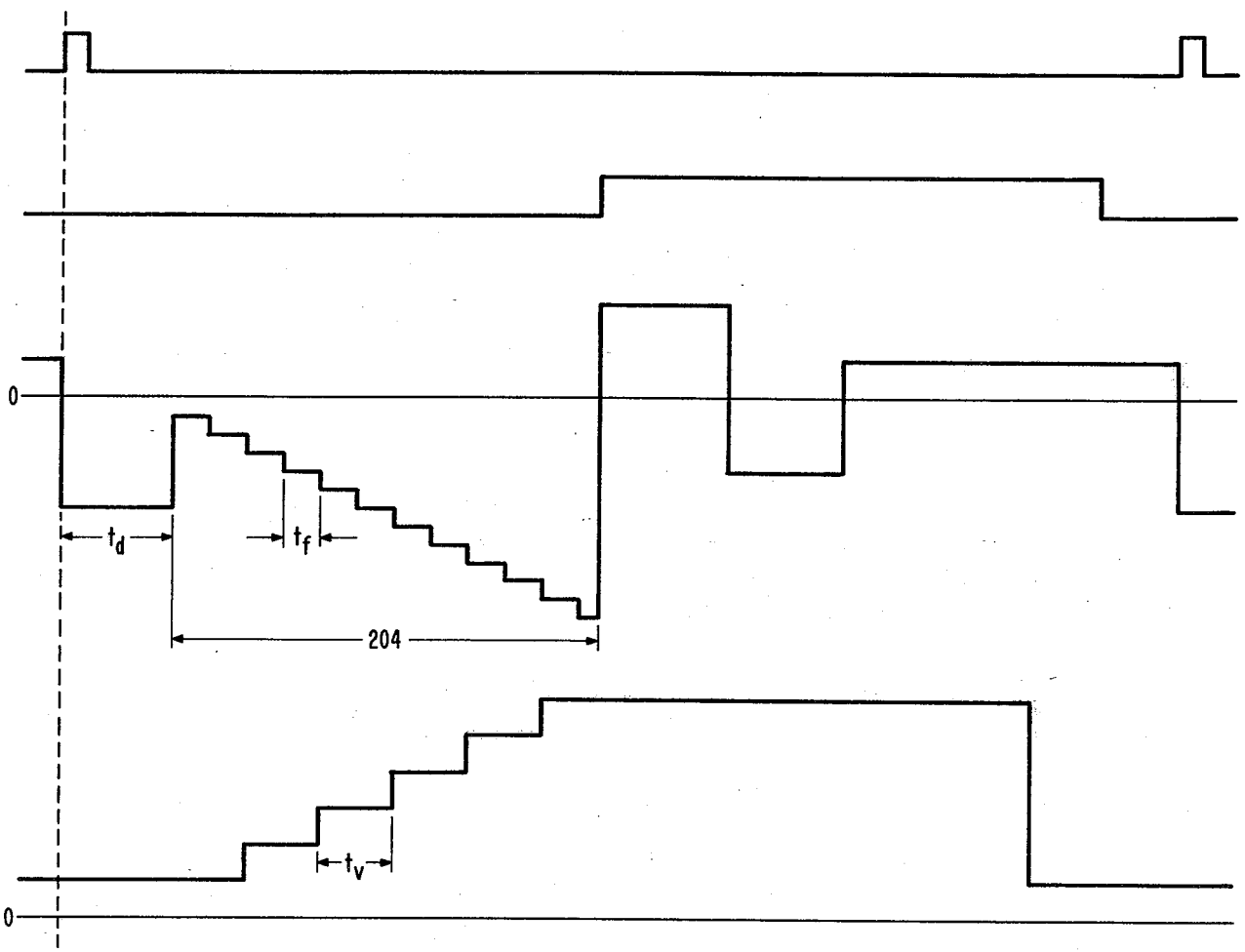
FIG. 12 shows a timing diagram for the electronic system of FIG. 11.

FIG. 11 shows in block diagram form, an electrical system necessary to drive the shingler 10. FIG. 12 shows a timing diagram for the rotary shingler when driven by the electrical system described in FIG. 11. The start feed pulse is outputted from a utilization device, for example, a convenience copier. The pulse is outputted on shingler conductor 147. The shingler conductor is connected to controller 148. Controller 148 generates electrical signals for varying the force with which the rotary shingler contacts the sheets in a stack and the velocity with which the shingler is rotated when in contact with said stack. The controller 148 can be discrete electrical circuits joined in an appropriate manner or a microcomputer or minicomputer. In the preferred embodiment of this invention, the controller 148 is a minicomputer. The minicomputer is programmed in a conventional manner to generate variable digital control words on multiplexor busses 150 and 152, respectively. The controlled word on multiplexor buss 150 is called the force reference control word. This word controls (that is adjusts) the force with which motor 85 (FIGS. 1 and 11) loads the rotary shingler onto a stack of sheets. The force reference control word also controls the lowering and raising of the rotary shingler relative to the stack. The microcomputer 148 is programmed in a conventional manner so that the contents of the variable word on multiplexor buss 150 is periodically changed to increase the force as a function of time or to reverse the current in motor 85 thereby raising the shingler from the stack. The multiplexor buss 150 is coupled to bipolar digital-to-analog converter (DAC) 158. The bipolar DAC is a conventional DAC which converts the digital word outputted on multiplexor buss 150 into an analog signal and outputs the signal on conductor 162. As was pointed out previously, the shingler 34 (FIG. 1) must be moved bidirectionally, that is to contact the stack for shingling and to recede from the stack as soon as a sheet is shingled and is sensed downstream from the stack. To this end, the bipolar DAC generates a positive signal or a negative signal on conductor 162. The difference in polarity of signal 162 changes the direction of current flow in motor 85 and therefore assures bidirectional movement of the shingler. The analog signal on conductor 162 is fed into a power amplifier (PA) 164. In the preferred embodiment of this invention, the power amplifier is operated in the current mode (I-MODE). The output from the power amplifier $I_f$ is fed over conductor 166 to motor 85. As was stated previously, motor 85 drives the rotary shingler into and away from the stack of sheets. A feed-back loop 168 interconnects the motor to the input of power amplifier 164. A resistor R connects the motor to ground. As is well known in the motor art, the force (torque) output of DC motor 85 is directly proportional to its current. That is:

$$F=K_m I_f$$

Since F changes (that is adjusts) in accordance with the variable word outputted on multiplexor buss 150, the force which motor 85 imparts to the rotary shingler also adjusted in accordance with the variable word. Likewise, the bipolar DAC changes the sign of F which enables the shingler to contact or to remove from the stack. In the preferred embodiment of this invention, the force (F) which is exerted by motor 85 is a function of time. Preferably, the force starts at a low value and increases as time progresses. To this end, the force profile is preferably a step function and conventional programming techniques are used to program the microcomputer 148 to change the word on multiplexor buss 150 in accordance with a variable force profile. The variable word profile (FIGS. 8A, 8B and 12) is stored in nonvolatile form in the microcomputer. The pick sensor senses when a sheet is rotated from the stack and outputs a signal on conductor 170. The signal on conductor 170 is processed by microcomputer 148 and is used to adjust the contents of the variable word on multiplexor buss 150 so that the shingler is lifted from the stack of sheets.

Still referring to FIG. 11, the variable digital word which is outputted on multiplexor buss 152 is called the velocity reference word. This word is used to adjust the velocity with which the rotary shingler rotates. The multiplexor buss 152 is connected to the input of a unipolar DAC 160. The function of the unipolar DAC 160 is to convert the digital word on multiplexor buss 152 into an analog signal ($V_r$) which is outputted on conductor 172. The signal $V_r$ is the velocity reference signal. This signal is used to adjust the velocity with which the rotary shingler rotates. Since the rotary shingler needs to rotate in a single direction, a unipolar DAC is used. If it is desired to rotate the shingler bidirectionally, then a bipolar DAC should be used. The velocity reference signal $V_r$ is fed into the velocity loop of motor 55. As was stated previously, motor 55 rotates the shingler in the direction shown by $\omega$. The velocity of the shingler is increased or adjusted by changing the energization to motor 55. To this end, a conventional velocity transducer 174 is coupled to the shaft of motor 55. The velocity transducer 174 is a conventional tachometer which has the capability of measuring the velocity at which the motor is driving the shingler and outputs a signal on conductor 176. The signal on conductor 176 is summed with the velocity reference signal on conductor 72 by summing circuit means 178. The discrepancies between the signals on conductor 172 and conductor 176 are outputted as an error signal on conductor 180. The error signal is amplified by power amplifier 182 and is outputted on conductor 184 to drive the motor 55. In the preferred embodiment of this invention, the velocity of the motor is increased with time. Preferably, the rotary shingler begins at a relatively low velocity and is increased as a function of time until a sheet is peeled off from the stack. The microcomputer is therefore programmed using conventional methods so that the variable velocity reference word outputted on multiplexor buss 152 reflects the predetermined velocity profile.

Figure 13:
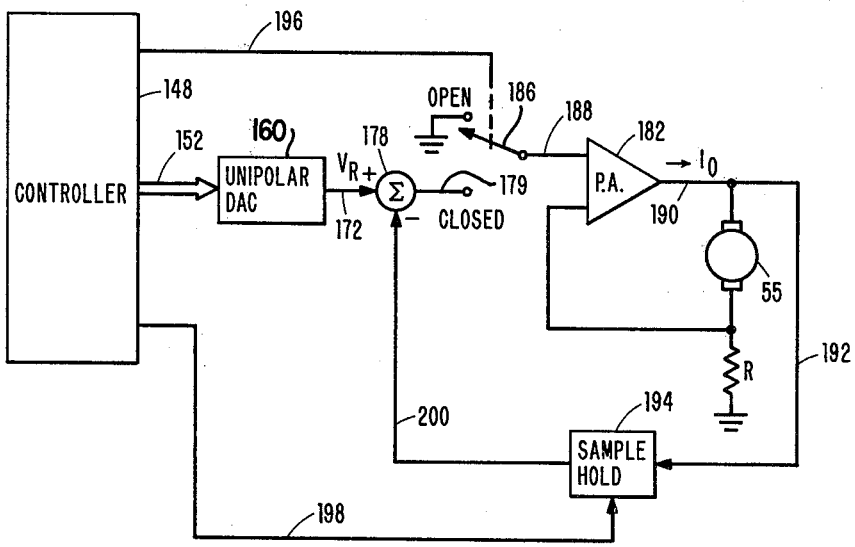
FIG. 13 shows an alternate electronic system for driving the rotary shingler.

FIG. 13 shows an alternate approach for controlling the velocity of the rotary shingler. In the figure, the back electromotive force (BEMF) of the motor is used to control the velocity of motor 55. Components in FIG. 13 which are common to components previously described in FIG. 11 are identified by identical numerals. Controller 148 is a microcomputer which is programmed to output variable velocity reference signals on multiplexor buss 152. The digital word on multiplexor buss 152 is converted into a velocity reference signal $V_r$ by unipolar DAC 160. The reference signal $V_r$ is fed over conductor 172 into summing circuit 178. The output of the summing circuit 178 is coupled to a double throw switch 186. The double throw switch 186 is coupled over conductor 188 to a power amplifier (PA) 182. The power amplifier is preferably operated in a current mode (I-mode) and the output from the amplifier is fed over conductor 190 into motor 55. Conductor 192 couples the motor 55 to sample hold circuit means 194. As will be explained subsequently, when a drive signal is outputted by controller 148 on conductor 196, the switch 186 is either closed or open. When the switch is in the open state, the back EMF is measured and a value representative of the back EMF is stored in the sample hold circuit means 194. A sample signal is generated by controller 148 on conductor 198. The sample signal enables the sample hold circuit means 194 to measure the BEMF of the motor and to store the measurement. It should be noted that the value of the BEMF is an accurate measurement of the velocity at which the rotary shingler is being driven by motor 55. The value stored in the sample hold circuit means 194 is outputted as an electrical signal on conductor 200 and is summed with the reference velocity signal $V_R$ on conductor 172 to generate an error signal on conductor 179. As can be seen from FIG. 13, the summing function is done by summing means 178. The controller 148 then generates a control signal on conductor 196. The signal closes the switch 186 and the error signal on conductor 179 is utilized by I-mode power amplifier 182 to adjust the current $I_O$. As was stated previously, the embodiment in FIG. 13 samples the BEMF generated by DC motor 55 to achieve velocity control. The drive signal on conductor 196 controls the input to power amplifier 182. In the preferred embodiment of this invention, the power amplifier is operated in the current mode (I-mode). When the drive signal on conductor 196 is at a high level, the switch 186 is opened. The current in power amplifier 182 decays to zero. In this state, the voltage across the motor is the back EMF. This back EMF is directly proportional to the rotational velocity of the motor. This back EMF is measured and stored in sample and hold circuit means 194. After the switch is opened and some time is allowed for transient in the motor to decay, the controller issues a sample pulse on conductor 198. The output of the sample and hold circuit means 194 now contains the measurement of the velocity of the rotary shingler. Following the sampling of the BEMF the controller lowers the sample line 198 into the hold mode and then closes the switch via a signal on drive line 196. As such, the difference between the signal on conductor 200 and the velocity reference signal on conductor 172 is outputted as an error signal and is used to drive the motor so that its velocity matches the predetermined velocity profile. Of course, it should be noted that other types of control for both velocity and force can be generated by those skilled in the art without deviating from the scope or spirit of the present invention.

Referring now to FIG. 12, a timing diagram for the force/velocity control system of FIG. 11 is shown. Each curve in the drawing is represented by its name which is indicative of the function performed by said curve. For example, the start/feed signal outputted from a utilization device on conductor 147 (FIG. 11) is identified as start/feed signal and is the first graph on the page. Likewise, the signal outputted on conductor 170 from the pick sensor (FIG. 11) is the second curve and is identified as shingle sensor signal. The third curve identified as variable force generating signals represents the force profile of the signal which changes the force to the shingler motor 85. The portion of the curve identified by numeral 204 represents the stepped signal which increases the force with which the shingler contacts a stack of sheets. As stated previously, the force to the shingler is changed by changing the current into the motor (85) which lowers and raises the shingler relative to the stack. The fourth curve in FIG. 12 represents the rotary shingler velocity signals. This signal is preferably a stepped signal and increases with time. Prior to receiving the start/feed signal from the utilization device, the shingler is held up off the paper via a hold-up current in the shingler drive motor 85. At this instant of time, the rotary shingler is rotating at a relatively low velocity. Upon receiving the start/feed command pulse, the controller 148 loads a negative value number for a predetermined time ($t_d$) into the bipolar DAC 158. This number is of sufficient magnitude to drive the shingler down onto the paper. After the elapse of time $t_d$, the bipolar DAC 158 is loaded with a small negative number. This produces a relatively low normal force on the paper. As time progresses, the value in the bipolar DAC 158 is increased every $t_f$ second. Likewise, the value of the number in the unipolar DAC 160 is also increased every $t_v$ second. As such, both the normal force with which the shingler contacts the stack and the velocity of the shingler is increasing. The increase continues until the sensor disposed downstream from the stack senses the leading edge of a sheet. At this time, a feedback signal is generated on conductor 170 and the rotary shingler is lifted off the paper via the controller. It is worthwhile noting at this point, that the velocity of the shingler can be increased while the normal load remains constant or vice versa. Sometime before the next start/feed command pulse is outputted, the rotary shingler DAC is loaded with a small value to get the rotational velocity back to its initial slow velocity.

While the invention has been particularly shown and described with reference to a preferred embodiment thereof, it will be understood by those skilled in the art that various changes in form and details may be made therein without departing from the spirit and scope of the invention.

What is claimed is:

1. Sheet handling apparatus for separating sheets from a stack of sheets by virtue of the wave generator shingling phenomena; comprising:

a member mounted to rotate, in one direction, and in a plane generally parallel to the plane of the sheets within the stack;

a plurality of free-rolling sheet engagement means mounted to the extremities of the member;

means operable to bring the rolling sheet engagement means into contact with the topmost sheet in the stack;

force application means associated with the member and operable to contact the stack, at the center of rotation of said member, with a force for restraining linear motion of the sheets as said member rotates relative to the force application means, and sheets are shingled from said stack;

motor means coupled to said member and operable to rotate said member;

sensor means operable to sense a sheet which has been shingled from said stack; and control means responsive to said sensing means and operable, in the absence of a shingled sheet at said sensor means, to increase the rotational velocity of said member, and said restraining force, in a predetermined manner and as a function of time.

2. The apparatus of claim 1 further including a sheet feed mechanism operable to pick a shingled sheet and to feed said sheet into the paper path of a utilization device.

3. The apparatus of claim 1 wherein the sheet engagement means includes feed rollers.

4. The apparatus of claim 1 wherein the force application means includes a pin disposed in a plane substantially perpendicular to the plane of the stack, and force means for forcing the pin onto the stack.

5. The apparatus of claim 4 wherein the force means is a spring.

6. The apparatus of claim 1 wherein the means to bring the sheet engagement means into contact with the stack includes a bidirectional rotary motor with a rotary shaft extending therefrom;

mechanical linkage means pivotally mounted to said shaft;

force transmission means fixedly connected to the mechanical linkage means;

an elongated arm with bifurcated extremities disposed in a plane substantially parallel to the plane of the stack, said elongated arm having one of the bifurcated extremities operably coupled to the force transmission means, and having the other extremity operably coupled to said member;

pivotal means operably disposed between the extremities of said elongated arm; and wherein said control means is additionally responsive to said sensing means, and is operable to energize said motor in the absence of a shingled sheet at said sensor means, to increase the force with which said sheet engaging means engages said stack, said increased force being accomplished in a predetermined manner and as a function of time.

7. Device for shingling sheets in seriatim from the top of a stack comprising in combination:

shingling-type sheet separating means operable to contact the topmost sheet of said stack, said separating means being rotatable in a plane generally parallel to the topmost sheet, and including means to apply a force to the topmost sheet at the center of rotation of said separating means;

variable-force generating means associated with sheet separating means and operable to apply a variable force with which said sheet separating means engages said stack;

variable-velocity rotary means operable to rotate said sheet separating means;

sensor means operable to sense a sheet which has been shingled from said stack; and controller means responsive to said sensor means and operable to simultaneously adjust the force applied by the force generating means and the rotational velocity of the separating means.

8. The device of claim 7 wherein said controller means includes a microcomputer operable to generate a force reference signal and a velocity reference signal;

bipolar digital-to-analog circuit means operable to accept said force reference signal and to generate an analog signal therefrom; and power amplifier means operable to accept said analog signal and to generate a variable energizing current which is applied to said rotary means.

9. The device of claim 8 further including unipolar digital-to-analog circuit means operable to accept said velocity reference signal and to generate an analog velocity reference signal therefrom; and summing means to correlate said analog velocity reference signal with a velocity feedback signal derived from said rotary means, and to generate an error signal which is applied to said rotary means for adjusting the velocity of said rotary means.

10. A method for feeding sheets having a wide range of feeding characteristics and weights, said method comprising:

rotating a rotary shingler in a plane parallel to the stack's top sheet, and with a predetermined velocity relative to a stack of sheets;

contacting the topmost sheet in the stack with the rotary shingler;

applying a point-force to the stack at the center of rotation of said rotary shingler;

applying a force to load the rotary shingler onto the stack;

increasing the load force and the rotary velocity of said shingler as a function of time; and retracting the shingler and the point-force from said stack when a sheet is separated from the stack by operation of said shingler.

11. The method of claim 10 wherein the force and the velocity are adjusted in accordance with a ramp function.

12. The method of claim 10 wherein the force and the velocity are adjusted simultaneously.

13. A sheet handling device for feeding sheets in seriatim from a stack onto a processing station of a utilization apparatus comprising:

means operable to support a stack of sheets;

rotary shingler means disposed to contact the stack periodically, and to rotate in a plane substantially parallel to the plane of the stack, said rotary shingler being operable to contact the stack with a variable force and velocity;

force application means associated with said rotary shingler means, said force application means being operable to contact the stack at the center of rotation of said rotary shingler, to impart a constant restraining force so that sheets are shingled at a constant angle from said stack;

sheet feed means disposed relative to the stack, said sheet feed means being operable to receive a shingled sheet and to reorientate the sheet to conform to a predetermined paper path;

sheet aligner means disposed within said paper path, said sheet aligner means being operable to align a sheet traversing said path; and controller means for adjusting the variable force and velocity in timed relation with a predetermined force and velocity profile.

14. The device of claim 13 further including servo-controlled means positioned relative to said processing station.

15. The device of claim 13 further including controller means for adjusting the variable force and velocity in timed relation with a predetermined velocity and force profile

16. The device of claim 13 further including motor means for rotating said shingler means, said motor means being controlled by said controller means.

17. The device of claim 13 further including power means coupled to said rotary shingler means, said power means being operable to move said shingler means in a plane substantially perpendicular to the plane of rotation of said shingler means, and to adjust the normal force with which said shingler means contacts said stack, and means connecting said controller means in controlling relation to said power means.

18. The device of claim 13 further including sensor means disposed intermediate said stack and said sheet feed means, said sensor means being operable to sense the leading edge of a shingled sheet, and to output a first set of pulses to control said controller means.

* * * * *